United States Patent [19]

Grover

[11] 4,020,898

[45] May 3, 1977

[54] HEAT PIPE AND METHOD AND APPARATUS FOR FABRICATING SAME

[75] Inventor: George M. Grover, Los Alamos, N. Mex.

[73] Assignee: Q-Dot Corporation, Dallas, Tex.

[22] Filed: Feb. 14, 1973

[21] Appl. No.: 332,417

[52] U.S. Cl. ..... 165/105; 122/366; 165/110

[51] Int. Cl. ..... F28d 15/00

[58] Field of Search ..... 165/105, 110; 122/366

[56] References Cited

UNITED STATES PATENTS

| | | | |
|---|---|---|---|
| 1,690,108 | 11/1928 | Grady | 165/105 |
| 2,237,054 | 4/1941 | Jensen | 165/105 X |
| 3,734,173 | 5/1973 | Moritz | 165/105 |

FOREIGN PATENTS OR APPLICATIONS

| | | | |
|---|---|---|---|
| 22,272 | 1892 | United Kingdom | 165/105 |

*Primary Examiner*—Albert W. Davis, Jr.
*Attorney, Agent, or Firm*—Hubbard, Thurman, Turner & Tucker

[57] ABSTRACT

A thermal transfer system comprising a closed, generally horizontally disposed tubular envelope having heat transfer fins mounted at axially spaced points along its outer surface is disclosed. The interior surface of the tubular envelope has a large number of small circumferentially extending capillary grooves characterized by a restricted opening relative to the base of the grooves. A liquid phase/vapor phase working fluid is contained within the envelope with the liquid phase normally comprising about 50 to about 75 percent of the volume of the envelope at normal operating temperatures. A liquid phase return tube rests on the bottom of the envelope and is open at both ends. The liquid phase return tube has an inside diameter of about 30 to about 40 percent of the inside diameter of the tubular envelope and has a length of between about 65 percent and about 85 percent of the length of the envelope.

In the operation of the system, one end of the tubular envelope is normally at a relatively higher temperature compared to the other end. The working fluid is vaporized in the higher temperature end of the envelope and the vapor phase flows to the lower temperature end through the portion of the envelope outside of the liquid phase return tube. The working fluid is condensed at the lower temperature end of the envelope and returns in the liquid phase to the evaporator end through the liquid phase return tube. The action of the vapor phase flowing along the outside of the return tube causes a distribution of some liquid along the entire length of the envelope so that the liquid phase can be spread circumferentially around the envelope by the capillary grooves to increase the area of the liquid-vapor interface.

24 Claims, 8 Drawing Figures

HEAT PIPE AND METHOD AND APPARATUS FOR FABRICATING SAME

BACKGROUND OF THE INVENTION

This invention relates generally to thermal transfer systems, and more particularly to a sealed pipe containing a working fluid which is alternately evaporated and condensed to transfer heat.

A heat pipe comprises a sealed envelope containing a working fluid having both a liquid phase and a vapor phase which is the desired range of operating temperatures. When one portion of the envelope is exposed to a relatively higher temperature, it functions as an evaporator section. The working fluid is vaporized in the evaporator section and flows in the vapor phase to the relatively lower temperature section of the envelope which becomes a condenser section. The working fluid is condensed in the condenser section and then returns in the liquid phase in a short time from the higher temperature section of the envelope to the lower temperature section as a consequence of the phase change of the working fluid.

Because it operates on the principle of phase change rather than on the principles of conduction or convection, a heat pipe is theoretically capable of transferring heat at a much higher rate than conventional heat transfer systems. Nevertheless, a number of difficulties have heretofore been experienced in attempting to use heat pipes in commercially attractive applications. For example, until quite recently the only heat pipes actually in operation utilized a capillary wick to transport the liquid phase longitudinally of the pipe from the evaporator section to the condenser section. In heat pipes using a wick the quantity of working fluid is selected so that no surplus liquid phase is provided at the desired operating temperature. As a result there is only modest interference between the liquid phase and the vapor phase. However, capillary wicks are difficult and expensive to install properly, and for this reason the use of heat pipes incorporating such wicks has been limited to special and very expensive applications such as in nuclear reactors and space craft.

If a heat pipe envelope is generally tubular in shape and is disposed substantially horizontally, the liquid phase of the working fluid will return to the high temperature of the heat pipe in either direction under the action of gravity so that heat transfer is bidirectional and does not require a capillary wick to return the working fluid to the evaporative section, thus permitting a more inexpensive heat pipe to be used. However, this type of heat pipe exhibits a particular problem which heretofore has limited its heat transfer capability to rates considerably below the theoretical level in the absence of such liquid entrainment. The problem is that even at relatively low heat transfer rates the liquid phase of the working fluid returns from the condenser portion to the evaporator portion of the heat pipe in a series of waves. These waves tend to interfere with the flow of the vapor phase of the working fluid from the evaporator portion to the condenser portion of the heat pipe, and thereby tend to limit the heat transfer capability of the heat pipe. At high heat transfer rates, the waves reach sufficient magnitude to form slugs which completely block flow of the vapor phase back to the condenser, thus substantially killing transfer of heat by phase change since as one slug disappears, another slug forms.

A closed cycle heat transfer system similar to a heat pipe was first disclosed in British Pat. No. 22,272 granted to Perkins et al on Dec. 5, 1892. However, efforts to use the so-called Perkins tube has been limited to application in which very short tubes are used, probably because the systems proposed by Perkins are not sufficiently effective to be of interest commercially, as will hereinafter be shown in greater detail.

SUMMARY OF THE INVENTION

In accordance with the present invention, a thermal transfer system is provided which includes heat pipe means inclined to horizontal and having opposite evaporator and condenser sections disposed in thermal exchange relationship in fluid flow streams of higher and lower temperatures, respectively. The heat pipe means comprises an elongated conduit means containing working fluid partially filling the same, said conduit means being of thermally conductive material and defining a passage extending through both of said sections and being many times longer than wide. The conduit means is internal capillary structure distributed throughout said evaporator and condenser sections for effecting widely distributed wicking of liquid working fluid to promote large area thermal transfer between said liquid working fluid and said fluid flow streams through said conduit means. This results in a cyclic flow pattern characterized by unidirectional flow of vapor working fluid originating along the length of the evaporator section and condensing to liquid working fluid along the length of the condenser section. An elongated duct means extends lengthwise in lower passage regions of the evaporator and condenser sections of said conduit means and in substantially thermally isolated relation to said conduit means. The duct means has port means communicating with the end of the condenser section to receive liquid working fluid swept towards the low temperature region of the passage by the unidirectional flow of vapor working fluid and port means near the end of the condenser section to pass such liquid working fluid by gravity to the evaporator section where the unidirectional flow of vapor working fluid distributes the liquid working fluid along the lower regions of the evaporator section and the internal capillary structure thereof then distributes the liquid working fluid circumferentially throughout large areas of the evaporator section.

In accordance with more specific aspects of the invention, the liquid return passageway comprises a tube having an inside diameter equal to approximately 30 to 40 percent of the inside diameter of the heat pipe. The length of the return tube is between about 65% and about 85% of the length of the heat pipe. The working fluid preferably fills the heat pipe to such an extent that the liquid phase of the working fluid at the working temperature comprises from about 50% to about 75% percent of the volume of the heat pipe within the normal range of operation of the system. These parameters have been found to provide a heat pipe having maximum heat transfer capability.

DESCRIPTION OF THE DRAWINGS

A more complete understanding of the invention may be had by referring to the following Detailed Description when taken in conjunction with the accompanying Drawings, wherein.

Figure 1:
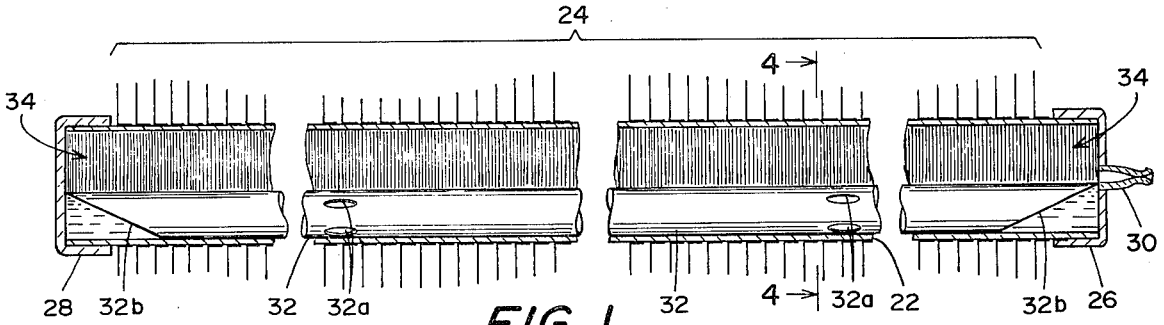
FIG. 1 is a longitudinal sectional view of a system incorporating the present invention, with the central portion omitted for clarity.

A heat pipe incorporating the present invention is indicated generally by the reference numeral 20. The heat pipe 20 includes an outer tubular envelope 22 which is typically at least 6 to 8 feet in length and between ½ and ¾ of an inch in diameter. The envelope 22 is typically fabricated from copper or aluminum tubing due to the excellent thermal conductivity and resistance to corrosion of these materials. A plurality of conventional heat exchanger fins 24 are mounted at axially spaced points on the exterior of the tubular envelope 22 in such a manner as to provide good heat transfer between the fins and the envelope. The fins 24 would usually be eliminated where heat exchange is to be made with a liquid rather than a gas.

The opposite ends of the tubular envelope 22 are hermetically sealed by end caps 26 and 28. In the construction of the heat pipe 20, the envelope 22 is first evacuated through a fitting 30 of the end cap 26. Thereafter, the envelope 22 is filled with a liquid phase/vapor phase working fluid 31, such as refrigerant R12. The fitting 30 is then permanently sealed, such as by crimping and soldering or welding.

Figure 3:
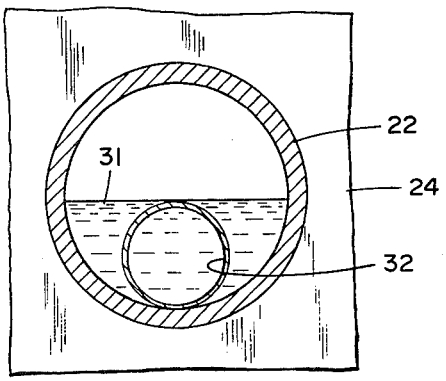
FIG. 3 is a transverse sectional view taken generally along the line 4—4 in FIG. 1.

The quantity or working fluid that is utilized in the heat pipe 20 has been found to be highly important to the proper operation of the device. It has been determined that the heat transfer capability of the heat pipe 20 is maximized if the quantity of working fluid in the heat pipe is such that the liquid phase of the working fluid comprises from about 50% to about 75% of the volume of the tubular envelope 22 at the desired operating temperature. This condition is illustrated in FIGS. 1 and 3, it being understood that during the actual operation of the heat pipe 20 the level of the working fluid is far from being uniform along the length of the tubular envelope 22.

Figure 8:
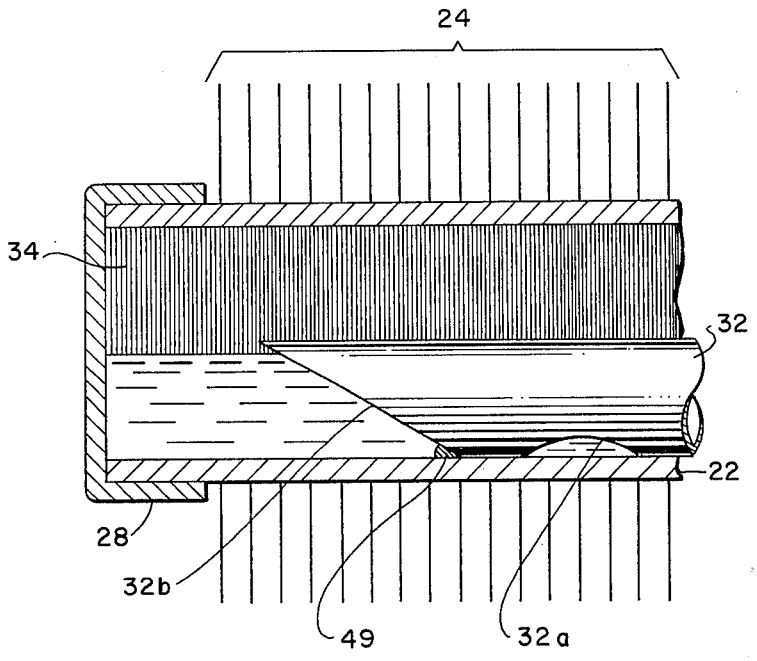
FIG. 8 is a longitudinal view of one end of a heat pipe system of this invention showing an elongated duct means that terminates short of the end of the outer conduit with retainer means to limit the lengthwise shifting movement of the duct.

A liquid phase return tube 32 is disposed within the tubular envelope 22 and rests on the bottom of the envelope. The tube 32 may be formed from thin wall copper tubing, and has an inside diameter equal to from about 15% to about 20% of the inside diameter of the tubular envelope 22. The liquid phase return tube 32 is preferably about two-thirds as long as the tubular envelope 22, however, successful results have been obtained utilizing liquid return tubes having lengths of between about 65% and about 85% of the length of the tubular envelope 22. The effective length of tube 32 is determined by ports **32*a*. However, the tubes 32 extend substantially the length of the envelope 22 in order to ensure that the ports 32*a* are located at the proper position in the envelope with the ends 32*b* cut on a taper to ensure that no liquid or vapor is trapped in the ends of the tube. FIG. 8 illustrates the heat pipe system of this invention wherein elongated duct means 32 is disposed in movable relation in conduit means 22 and terminates short of end 28 of tubular envelope 22 and retainer means 49 connect between tubular envelope 22 and duct means 32 to limit lengthwise shifting movement of duct means 32 while permitting gravity control of transverse movement of duct means 32 relative to tubular envelope 22. As shown in FIG. 8, duct means 32 has axial port means 32*a* bordered by beveled end face portions 32*b* of duct means 32 and retaining means 49 connect with duct means 32 near the endmost extremes of the end face portions 32*b* of duct means 32. The interior periphery of the tubular envelope 22 is provided with closely spaced, circumferentially extending capillary grooves 34 throughout its entire length. When the working fluid of the heat pipe 20 is the refrigerant R12, the capillary grooves 34 may have a peak to trough depth of about 0.014 inch, and a spacing of about 0.007 inch. The capillary grooves 34 may comprise a continuous helix groove to facilitate manufacture as described in copending application Ser. No. 113,394, entitled HEAT PIPE METHOD AND APPARATUS FOR FABRICATING SAME, now U.S. Pat. No. 3,753,364, and assigned to the assignee of the present invention, or a series of separate, annular grooves. The capillary grooves 34 preferably have a cross-section characterized by an opening of reduced width, such as that shown in FIG. 4, where it will be noted that the openings 36 of the grooves 34 are narrower than the bottom portions 38 thereof. This cross-sectional configuration provides optimum capillary action to transport liquid at a maximum rate. Additionally, the metal strips or lands 40 which form the grooves provide a low thermal impedance path from the heat pipe walls to the liquid vapor interface of the working fluid, and thereby enhance evaporation and condensation of the working fluid within the heat pipe 20.**

The operation of the heat pipe 20 may be understood by assuming that the tubular envelope 22 is oriented horizontally so as to operate in the reversible mode. However, it is to be understood that for non-reversible applications, the heat pipe may be inclined slightly upwardly from the evaporator end so that gravity will assist in returning the liquid phase through the liquid retain tube. Assume further that the left hand end (FIG. 2) of the tubular envelope 22 is maintained at a relatively high temperature and that the right hand end is maintained at a relatively low temperature. Under these circumstances it is conventional to refer to the high temperature end as the evaporator section and to refer to the low temperature end of the heat pipe as the condensor section.

Due to the relatively high temperature of the evaporator section, the working fluid is transformed from the liquid phase to the vapor phase. The resulting vapor phase flows through the portion of the tubular envelope 22 outside of the liquid phase return tube 32 to the condensor section. Due to the relatively low temperature of the condensor section, the working fluid is transformed from the vapor phase to the liquid phase. The liquid phase of the working fluid is returned from the condensor section of the heat pipe to the evaporator section through the liquid phase return tube 32.

Figure 5:
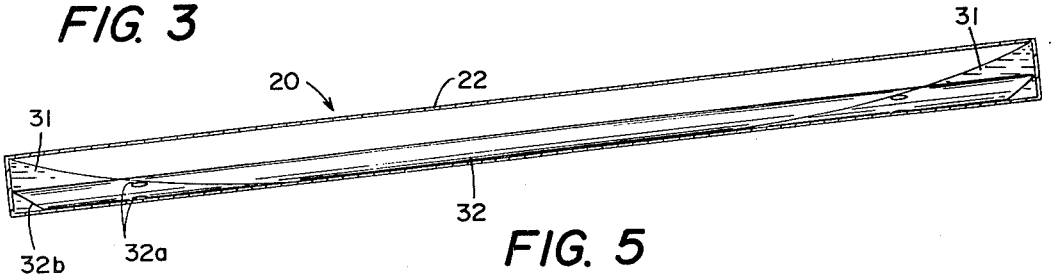
FIG. 5 is a schematic longitudinal sectional view of the system of FIG. 1 with the longitudinal dimension greatly reduced in relation to the diametrical dimension.

When the liquid phase exits through the openings 32*a* in the evaporator section, the vapor phase generated between the openings and the end of the pipe 22 tends to sweep the liquid toward the condensor section, thus supplying the liquid phase to the grooves 34 over the entire length of the evaporator section. The capillary grooves 34 then transport the liquid circumferentially to provide the desired heat pipe operation. The effect is that the liquid stands in the tube 22 substantially as illustrated in FIG. 5 wherein the length dimension of the tube 22 is greatly reduced in comparison to the diametrical or width dimension. It will be noted that the liquid phase tends to accumulate at both ends of the tube 22 as a result of the flow of the vapor phase.

After the present invention, the Perkins et al patent referred to previously was discovered as a result of prosecution of related applications. All embodiments disclosed in Perkins appear to be inoperative except for that shown herein in FIG. 6 and designated by the reference numeral 100. The devices shown in the British patent became sufficiently well known to be referred to as "Perkins tubes" in later British patents, all of which seem to use considerably different forms. The similarity in the Perkins tube 100 to the present invention led to a comparison of the operation of the device 100 with that of the system 20, with the results being shown in FIG. 7.

First consider the Perkins tube 100 which comprises tubular envelope 112 which is closed at both ends and hermetically sealed. The envelope 112 of the pipe 100 is charged with a suitable working fluid, typically water. The Perkins et al patent is silent as to quantities of working fluid that are to be used in the heat pipes disclosed therein. This omission is deemed to be highly significant in light of the present experiments which prove that the quantity of working fluid contained in a heat pipe is critical to be successful operation of the device. An inner tube 114 is supported within the tubular envelope 112 of the heat pipe 100 by means of a plurality of narrow connecting pieces 116. The specification of the Perkins et al patent states that the inner tube 114 is concentric with the tubular envelope 112. As is apparent from the patent, the inner tube 114 is substantially equal in length to the tubular envelope 112, with only small spaces being provided at the opposite ends of the heat pipe 100. All other embodiments of Perkins et al, which are the primary embodiments, appear to be inoperative, which may account for the fact that these systems are not used today.

Figure 2:
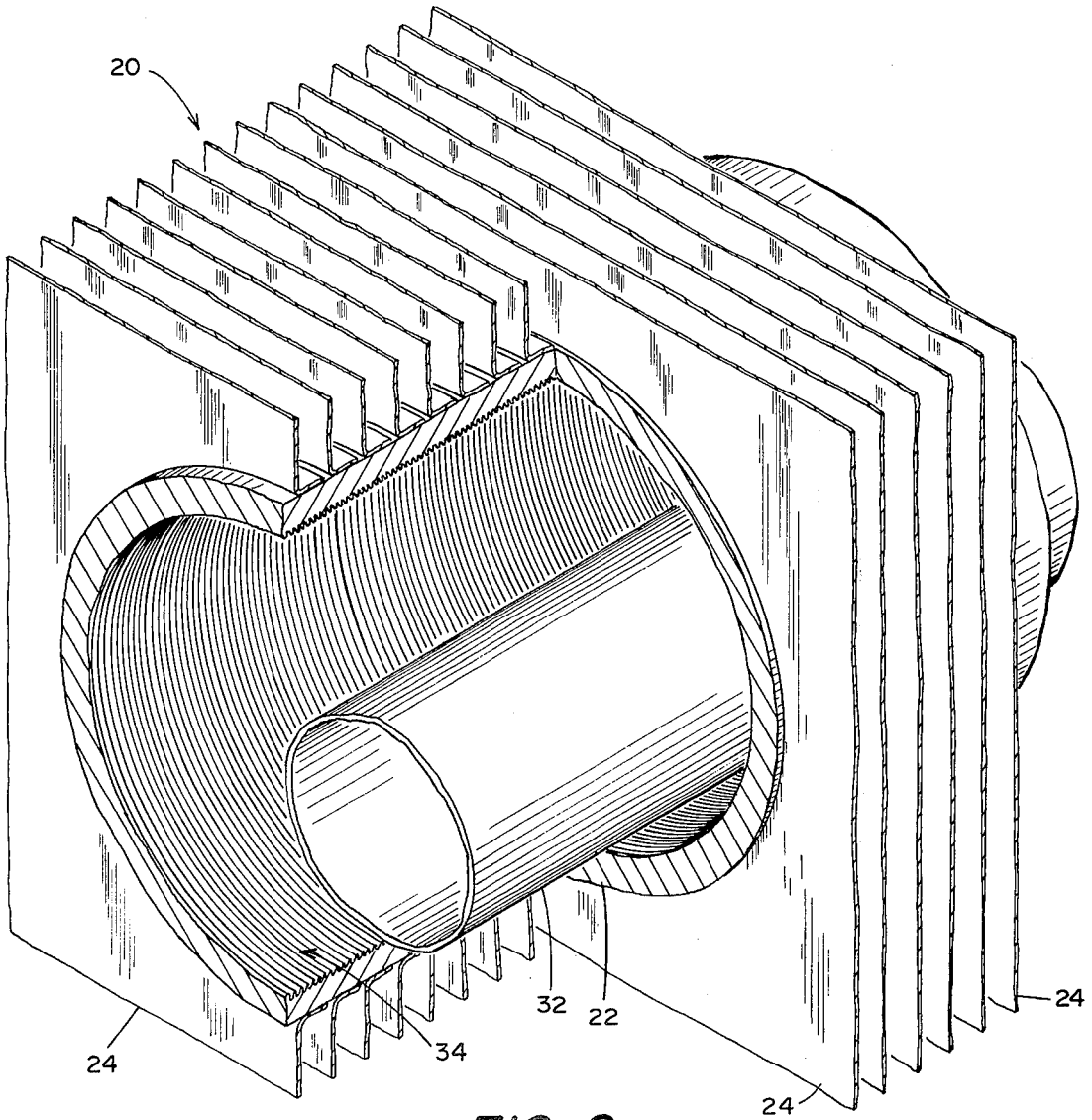
FIG. 2 is an enlarged perspective view of the system shown in FIG. 1 in which certain parts have been broken away to more clearly illustrate certain features of the invention.
Figure 4:
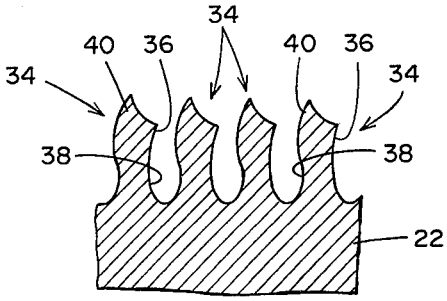
FIG. 4 is a greatly enlarged illustration of the capillary grooves of the system.
Figure 6:
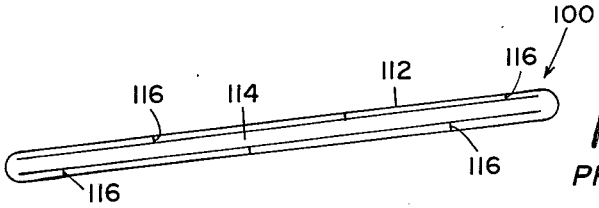
FIG. 6 PRIOR ART
FIG. 6 is a reduced longitudinal sectional view of a prior art heat pipe.
Figure 7:
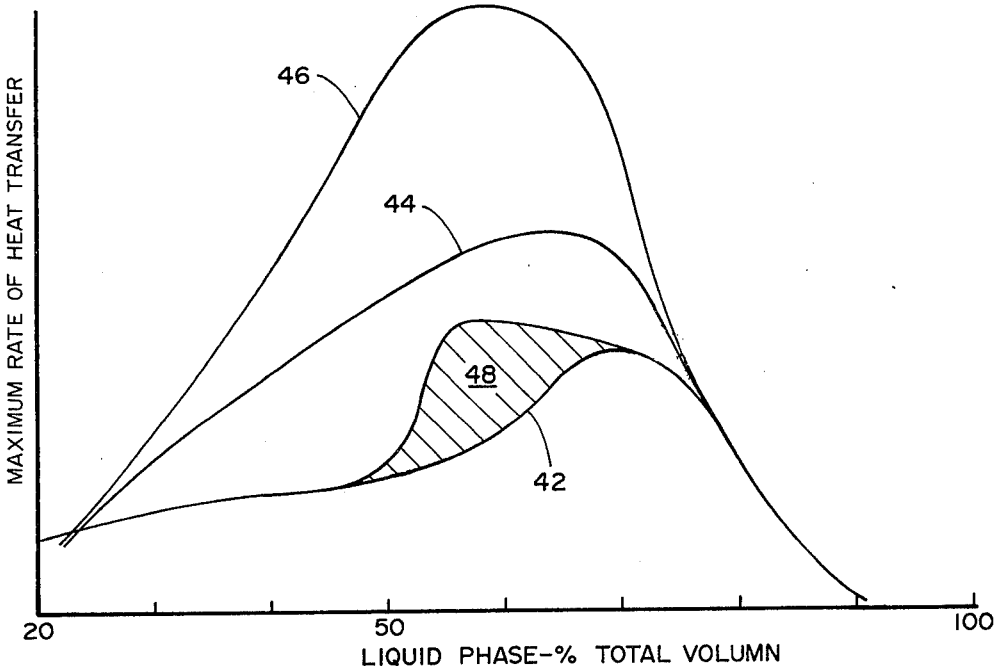
FIG. 7 is a chart comprising a comparison of the maximum heat transfer rates obtainable by means of the device shown in FIG. 6 and the system of the present invention.

An appreciation of the significance of the present invention may be had by referring to FIG. 7 where line 42 is a plot of the maximum heat transfer capability of the Perkins tube 100 shown in FIG. 6 as a function of the volume of working fluid in the tubular envelope 112 of the heat pipe. Line 44 is a plot of a heat pipe constructed substantially as shown in FIGS. 1, 2 and 3, but omitting the capillary grooves 34 in order to provide a direct indication of the importance of positioning the tube 32 at the bottom of tube 22. Line 46 shows a similar plot of the heat transfer capabilities of a heat pipe constructed as shown in FIGS. 2, 3 and 4. The various plots comprising FIG. 7 were made under circumstances such as to ensure a fair comparison of the three devices.

The Perkins tube 100 is limited by two significant factors. First, if the envelope 112 of the heat pipe 100 is filled with sufficient working fluid so as to fill the inner tube 114 as occurs at about 42*a*, insufficient space remains within the envelope 112 for the vapor phase of the working fluid. More significantly, there is always a substantial portion of the liquid phase of the working fluid in the portion of the tubular envelope 112 outside of the inner tube 114. This portion of the liquid phase of the working fluid is subject to the same wave action and slugging as is the liquid phase of the working fluid in a heat pipe which is not provided with structure for maintaining liquid phase/vapor separation, which results in a region of instability indicated by the shaded portion 48 in which the inner tube 114 remains full of liquid even though a low total quantity of working fluid is present within the heat pipe.

A comparison of curves 44 and 46 shows that the present invention has a maximum heat transfer capability approximately fifty percent greater than that of the Perkins tube merely because of the placement at the liquid phase return tube. The performance of the Perkins tube 100 is not adequate to be of interest commercially. The maximum heat transfer capability achieved by the complete system 20 including the capillary grooves is almost four times that of the Perkins tube 100 and is of great commercial interest.

From the foregoing, it will be understood that the present invention comprises a unique heat transfer system having substantially improved operating characteristics over similar systems of the prior art. One basis for the improved operating characteristics obtained by the present invention comprises means for achieving separation in the counter flow by liquid phase and vapor phases during operation of a heat pipe while simultaneously distributing liquid phase to all of the capillary grooves formed on the interior surface of the envelope. It is to be understood that the tubes 22 and 32 can have cross-sectional shapes other than circular without departure from the spirit and scope of the invention.

Although preferred embodiments of the invention have been illustrated in the accompanying Drawings and described in the foregoing Detailed Description, it will be understood that the invention is not limited to the embodiments disclosed but is capable of numerous rearrangements, modifications, and substitutions of parts and elements without departing from the spirit of the invention.

What is claimed is:

1. In a thermal transfer system that includes heat pipe means inclined to horizontal and having opposite evaporator and condenser sections disposed in thermal exchange relationship in fluid flow streams of higher and lower temperatures, respectively, said heat pipe means comprising an elongated conduit means containing working fluid partially filling the same, said conduit means being of thermally conductive material and defining a passage extending through both of said sections and being many times longer than wide, said conduit means having internal capillary structure distributed throughout said evaporator and condenser sections for effecting widely distributed wicking of the liquid phase of the working fluid to promote a large interface area between said liquid phase and the vapor phase originating along the length of the evaporator section and flowing at high velocity to the condenser section and condensing to liquid phase along the length of the condenser section, and elongated duct means formed of a separate element from said conduit means extending lengthwise in lower passage regions of the evaporator and condenser sections of said conduit means and in substantially thermally isolated relation to said conduit means, said duct means having port means communicating with said passage near the ends of the evaporator and condenser sections to receive liquid working fluid swept towards the low temperature region of the passage by said unidirectional flow of vapor phase and to pass such liquid working fluid by gravity to the evaporator section where backflow of liquid phase due to said unidirectional flow of vapor phase distributes the liquid phase along lower regions of the evaporator section and the internal capillary structure thereof distributes the liquid phase circumferentially throughout large areas of the evaporator section.

2. In a system as defined in claim 1 wherein the amount of working fluid in said conduit means is such that progressively deeper pooling of the liquid working fluid occurs adjacent each end of said passage by the action of the unidirectional flow of the vapor working fluid.

3. In a system as defined in claim 1 wherein the amount of working fluid in said conduit means is such that progressively deeper pooling of the liquid working fluid occurs adjacent each end of said passage by the action of the unidirectional flow of the vapor working fluid and is such that the pooling thereof adjacent the end of the condenser section covers the port means that communicates with the condenser section.

4. In a system as defined in claim 1 wherein the amount of working fluid in said conduit means is such that progressively deeper pooling of the liquid working fluid occurs adjacent each end of said passage by the action of the unidirectional flow of the vapor working fluid and is such that the pooling thereof at opposite ends of the passage covers the corresponding port means.

5. In a system as defined in claim 1 wherein said conduit means has a grooved internal surface constituting said capillary structure, said grooved internal surface being characterized by grooves extending angularly to the lengthwise direction of the conduit means.

6. In a system as defined in claim 1 wherein said conduit means has a grooved internal surface constituting said capillary structure, said grooved internal surface being characterized by grooves extending angularly to the lengthwise direction of the conduit means and said conduit means resting in supported relation along the bottom region of said grooved surface.

7. In a system as defined in claim 1 wherein said elongated duct means rests in supported relation along the bottom region of said capillary structure substantially free of area contact therewith.

8. In a system as defined in claim 7 wherein said elongated duct means is disposed in movable relation in said conduit means and terminates short of opposite ends of said conduit means and retainer means connect between said conduit means and said duct means to limit lengthwise shifting movement of said duct means while permitting gravity control of transverse movement of said duct means relative to said conduit means.

9. In a system as defined in claim 8 wherein said duct means has axial port means bordered by beveled end face portions of said duct means and said retaining means connects to said duct means near the endmost extremes of said end face portions.

10. In a system as defined in claim 7 wherein said elongated duct means extends substantially the full length of said passage to substantially limit lengthwise shifting of said duct means relative to said conduit means.

11. In a system as defined in claim 10 wherein the orientation of said duct means in said conduit means is such that said port means open downwardly and laterally of said duct means.

12. In a system as defined in claim 11 wherein said duct means includes additional axially directed port means bordered by beveled end face portions of said duct means.

13. A heat transfer system comprising:

a first generally horizontally disposed, relatively large diameter tube having a length many times greater than its height and having both ends closed and having a relatively high temperature portion and a relatively low temperature portion;

a quantity of liquid phase/vapor phase working fluid contained in the first tube for evaporation in the high temperature portion and for condensation in the low temperature portion whereby heat is transferred from the high temperature portion to the low temperature portion by phase change of the working fluid; and a second separate relatively small diameter tube disposed within the first tube in substantially thermally isolated relation to said first tube and extending along the bottom thereof from an opening in the low temperature portion to an opening in the high temperature portion whereby the liquid phase of the working fluid flow from the low temperature portion to the high temperature portion through the second tube and the vapor phase of the working fluid flows from the high temperature portion to the low temperature portion in that part of the first tube outside of the second tube.

14. The heat transfer system according to claim 13 further comprising a plurality of circumferentially extending capillary grooves formed on the interior of the first tube along substantially the entire length thereof for transporting the liquid phase of the working fluid about the level of the liquid phase standing at the respective capillary grooves.

15. The heat transfer system according to claim 13 wherein the high temperature and low temperature portions of the first tube comprise the opposite ends thereof and wherein the distance between the openings in the second tube is equal to between about 65% and about 85% of the axial length of the first tube.

16. The heat transfer system according to claim 13 wherein the inside diameter of the second tube is equal to about 30% to about 40% of the inside diameter of the first tube.

17. The heat transfer system according to claim 13 wherein the liquid phase of the working fluid in the tube normally comprises from about 50% to about 75% of the volume of the first tube.

18. A heat transfer system comprising:

an elongate, generally horizontally disposed tube having closed ends and having a relatively high temperature evaporator section and a relatively low temperature condenser section;

a quantity of liquid phase/vapor phase working fluid contained within said tube for evaporation in the evaporator section and condensation in the condenser section whereby heat is transferred from the evaporator section to the condenser section of the tube by phase change of the working fluid;

the interior of said tube comprisig a series of axially spaced capillary grooves each extending substantially circumferentially of the tube of substantially the entire length of the tube for raising the vapor phase/liquid phase interface of the working fluid within the tube above the level of the liquid phase; and separate means forming a liquid phase return passageway in the bottom of the tube in substantially thermally isolated relation to said tube and extending from an opening within the condenser section to an opening within the evaporator section whereby condensed working fluid flows from the condenser end to the evaporator end within the passageway and evaporated working fluid flows from the evaporator end to the condenser end outside the passageway.

19. The heat transfer system according to claim 18 wherein the liquid phase return passageway comprises a second, relatively small diameter tube disposed within the first tube and supported on the bottom thereof.

20. The heat transfer system according to claim 19 wherein the second tube has an inside diameter equal to about 30% to about 40% of the inside diameter of the first tube and a length equal to between about 65% and about 85% of the length of the first tube.

21. The heat transfer system according to claim 18 wherein the capillary grooves on the interior of the tube comprise a continuous spiral extending substantially the entire length of the tube and characterized by a relatively narrow aperture portion extending to a relatively wide interior portion.

22. A heat transfer system comprising:

an elongate, closed, tubular envelope formed from a thermally conductive material and defining an evaporator section and a condenser section;

the interior of said envelope comprising a series of axially spaced capillary grooves each extending around substantially the entire interior periphery of the envelope;

a quantity of liquid phase/vapor phase working fluid in the envelope whereby the fluid is vaporized in the evaporator end and is condensed in the condenser end of the tube; and a separate liquid phase return tube in substantially thermally isolated relation to said envelope extending axially of the envelope from the condenser end to the evaporator end for returning the condensed working fluid.

23. The heat transfer system according to claim 22 wherein the inside diameter of the liquid phase return tube is equal to about 30% to about 40% of the inside diameter of the tubular envelope, wherein the effective length of the liquid phase return tube is equal to between about 65% and about 85% of the length of the tubular envelope, and wherein the liquid phase of the working fluid normally comprises from about 50% to about 75% of the volume of the tubular envelope.

24. The heat surface system according to claim 16 wherein the capillary grooves of the tubular envelope are positioned closely adjacent one another throughout the entire length of the tubular envelope, and wherein each capillary groove is further characterized by a relatively narrow opening extending to a relatively wide interior portion.

* * * * *